United States Patent [19]

Shields

[11] 4,118,914

[45] Oct. 10, 1978

[54] VIAL ASSEMBLER

[76] Inventor: Walter A. Shields, 181-41 Henley Rd., Jamaica, N.Y., N.Y. 11432

[21] Appl. No.: 845,006

[22] Filed: Oct. 25, 1977

[51] Int. Cl.[2] ..... B65B 3/00; B65B 23/22

[52] U.S. Cl. ..... 53/282; 53/306; 53/328

[58] Field of Search ..... 53/37, 112 R, 264, 267, 53/279, 281, 282, 306, 319, 328

[56] References Cited

U.S. PATENT DOCUMENTS

| | | | |
|---|---|---|---|
| 1,710,074 | 4/1929 | Saviano | 53/282 X |
| 3,245,194 | 4/1966 | Carski | 53/282 X |
| 3,623,210 | 11/1971 | Shields | 53/319 X |
| 3,662,517 | 5/1972 | Tascher et al. | 53/282 |

*Primary Examiner*—Robert Louis Spruill
*Attorney, Agent, or Firm*—C. Bruce Hamburg

[57] ABSTRACT

An automatic machine is provided for partially filling a cylindrical vial having one open end with a liquid, inserting a plug into the open end and fitting a cap onto the open end. The machine includes two turrets. Each of the turrets has a plurality of notches in the periphery thereof, the notches each being sized and shaped for receiving a respective one of the vials in an orientation with the open end of the vial directed upwardly. A filling station for partially filling the vials with a liquid is associated with the first turret. The vials automatically transfer from the first turret to the second turret. Respective stations for plugging and capping the vials are associated with the second turret.

7 Claims, 12 Drawing Figures

VIAL ASSEMBLER

BACKGROUND OF THE INVENTION

This invention relates to an automatic apparatus for partially filling with a liquid a cylindrical vial having one open end, inserting a plug into the open end and fitting a cap onto the open end.

The vials for which this invention is specifically intended are glass vials which are used in hypodermic syringes of a certain type. The invention will, consequently, be described in connection with such vials. It will, of course, be understood that in principle, the invention is applicable to other vials and containers.

For some cases of heart failure, the person suffering the heart failure is resuscitated by a first aid treatment including the injection of a solution of sodium bicarbonate directly into the heart, by means of a hypodermic syringe. The sodium bicarbonate solution is contained in a cylindrical glass vial. The vial contains a plug and has an open end which is capped. The plug functions as a plunger for the hypodermic syringe. The cap preserves the sterility of the inside of the vial. Manual filling, plugging, and capping of the vials is out of the question for economic reasons. It is highly desirable to provide a single, automatic machine which effects all three operations.

It is a primary object of the invention to provide such a machine.

Other objects and advantages of the invention will be apparent from the following description of the invention.

BRIEF DESCRIPTION OF THE INVENTION

According to the invention, there is provided an apparatus for partially filling with a liquid a cylindrical vial having one open end, inserting a plug into the open end and a cap onto the open end. The apparatus comprises first and second turrets. The periphery of each of the turrets is provided with a plurality of notches. The notches are each sized and shaped for receiving a respective one of the vials in an upright orientation with the open end thereof directed upwardly. Means are provided for feeding respective vials into respective notches of the first turret so that each vial is received in a respective notch in an upright orientation with the open end thereof directed upwardly. Located adjacent the first turret is a filling station for partially filling vials in notches of the first turret with a liquid. Means are provided for rotationally indexing the turrets in opposite directions. The turrets abut each other, thereby defining the zone of closest mutual proximity of the turrets to facilitate transfer of vials from the first turret to the second turret. Means are provided for guiding transfer of the vials in the aforementioned zone from the first turret to the second turret. That zone is rotationally spaced from the filling station in the direction of rotation of the first turret so that the partial filling of the vials is effected before they are transferred to the second turret. Located adjacent the second turret is a plugging station for inserting plugs into the vials in notches of the second turret at a location rotationally spaced from the aforementioned zone in the direction of rotation of the second turret. A capping station is provided for fitting caps onto the vials in notches of the second turret at a location rotationally spaced from the plugging station in the direction of rotation of the second turret. Finally, means are provided for discharging the partially filled, plugged and capped vials from the second turret at a location rotationally spaced from the capping station in the direction of rotation of the second turret.

The means for feeding vials to the first turret may comprise a hopper. A ramp is upwardly inclined toward the first turret from the lower portion of the hopper. A wheel is provided for discharging vials from the lower portion of the hopper onto the ramp. The wheel is arranged to discharge the vials onto the ramp so that vials lie across the ramp.

The means for feeding vials to the first turret further comprises means for receiving the vials from the ramp and guiding the vials from the ramp to notches in the first turret and means for striking the vials thereby to propel the vials along the receiving and guiding means into the notches of the first turret. More specifically, the ramp extends to an elevation above the elevation of the top of the first turret and the receiving and guiding means comprises a chute extending substantially horizontally away from the ramp and substantially vertically downwardly to a position immediately above the first turret so that the vials drop into notches of the first turret in a vertical orientation.

The filling station may comprise a plurality of pumps. A respective nozzle communicates with each of the pumps. A carriage supports the nozzles above notches of the first turret. Means are provided for reciprocating the carriage substantially vertically so that cyclically the nozzles lower into and then raise out of the vials in respective notches of the first turret as the pumps pump liquid through the nozzles into the vials.

Means are provided for feeding the plugs to the plugging station. The feeding means may comprise a vibratory circular feed bowl for containing a supply of and feeding the plugs and a linear vibratory feeder communicating between the feed bowl and the plugging station. The plugging station further comprises a die having openings for receiving plugs from the linear feeder. The openings in the die are aligned with vials received in notches of the second turret. There is provided a respective punch for each of the openings in the die. Each of the punches is in alignment with a respective one of the die openings. A first carriage supports the die above notches of the second turret and a second carriage supports the punches above the die. There are provided respective means for reciprocating the first and second carriages substantially vertically so that cyclically the die lowers plugs to a position just above the mouths of respective vials and respective notches of the second turret whereupon the punches drive the plugs into the vials.

Means are provided for feeding the caps to the capping station. The feeding means may comprise a vibratory circular feed bowl for containing a supply of and feeding the caps and a linear vibratory feeder communicating between the feed bowl and the capping station. The capping station may further comprise a die having openings for receiving caps from the linear feeder. The openings in the die are aligned with vials received in notches of the second turret. A respective punch is provided for each of the openings in the die. Each of the punches is in alignment with a respective one of the die openings. Means are provided for supporting the die above notches of the second turret. A carriage supports the punches above the die. Means are provided for reciprocating the carriage substantially vertically so that cyclically the punches push caps onto vials in respective notches of the second turret.

DETAILED DESCRIPTION OF A PREFERRED EMBODIMENT

Figure 1:
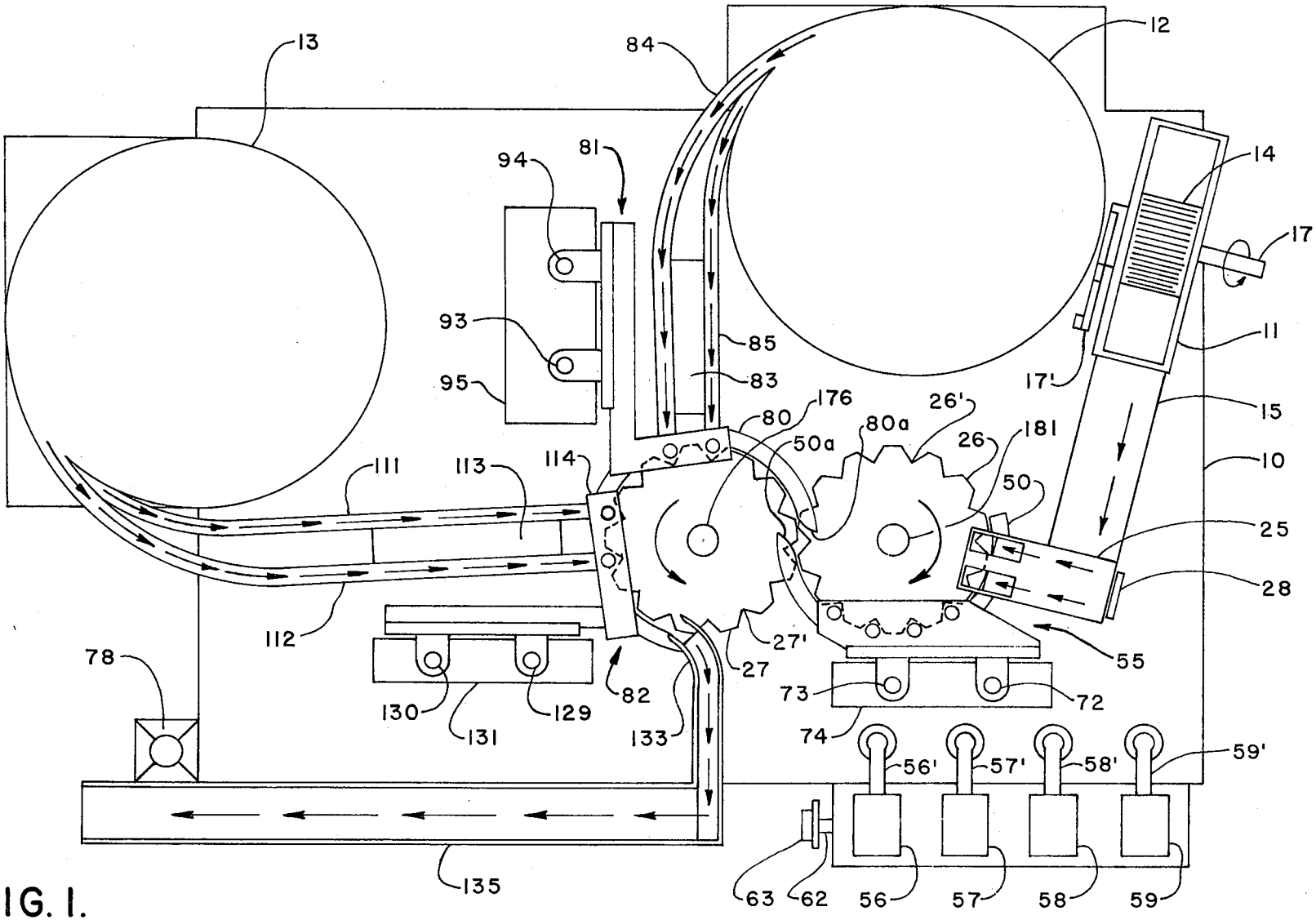
FIG. 1 is a plan view of a machine according to the invention.
Figure 2:
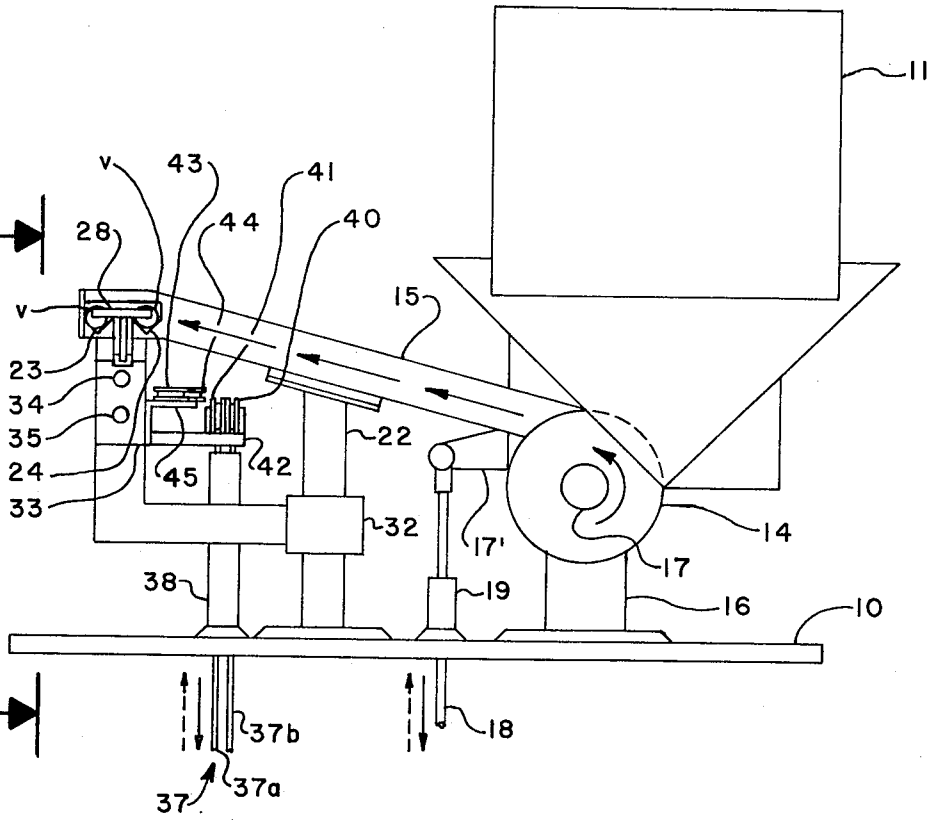
FIG. 2 is a side elevation of the vial feeding apparatus of the machine.

Mounted on the top plate 10 of a machine according to the invention are a hopper 11 for the glass vials of the glass vial-rubber plug-plastic cap assemblies to be assembled by the machine (FIGS. 1 and 2). Also mounted on the top plate 10 are a first vibratory circular feed bowl 12 for the plugs and a second vibratory circular feed bowl 13 for the caps. Each glass vial, which is cylindrical and closed at one end, is to be partially filled, for example to a three-quarters extent, with a liquid. A rubber stopper is then to be fully inserted into the vial above the liquid level. Finally, the open end of the vial is closed by means of a cap, having a smaller diameter portion which is received in the open end of the vial and a knurled portion of larger diameter than the inside diameter of the vial and which can be gripped for removal of the cap when the vial is to be used as part of a hypodermic syringe.

The hopper 11 is provided with a wheel 14 for feeding vials from the hopper 11 to an upward ramp 15 located adjacent the periphery of the wheel 14. The hopper 11, with its wheel 14, is supported by a pedestal 16 mounted on the top plate 10. The wheel 14 is rotationally indexed on its shaft 17 in the direction of the arrow on the wheel 14 in FIG. 2 sufficiently to deliver two vials onto the ramp 15. The indexing of the wheel 14 is effected by a conventional ratchet and pawl arrangement (not illustrated) by means of an arm 17' actuated by a reciprocating tie bar 18 which passes through the top plate 10 and a sleeve 19 mounted on the top plate 10.

The vials are each fed from the wheel 14 to the ramp 15 with the axis thereof parallel to the axis of the wheel 14. In this orientation, the vials are pushed up the ramp 15, which is supported at its mid-section by means of a pedestal 22 mounted on the top plate.

Figure 3:
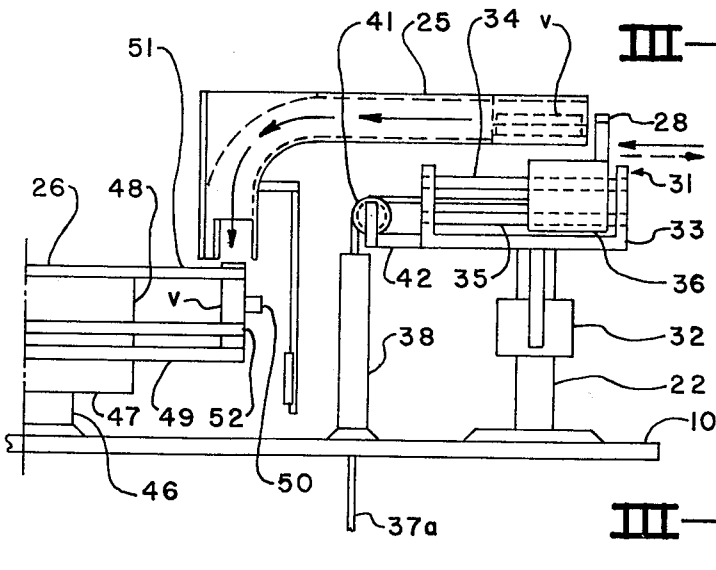
FIG. 3 is a side elevation viewed from plane III—III of FIG. 2.
Figure 4:
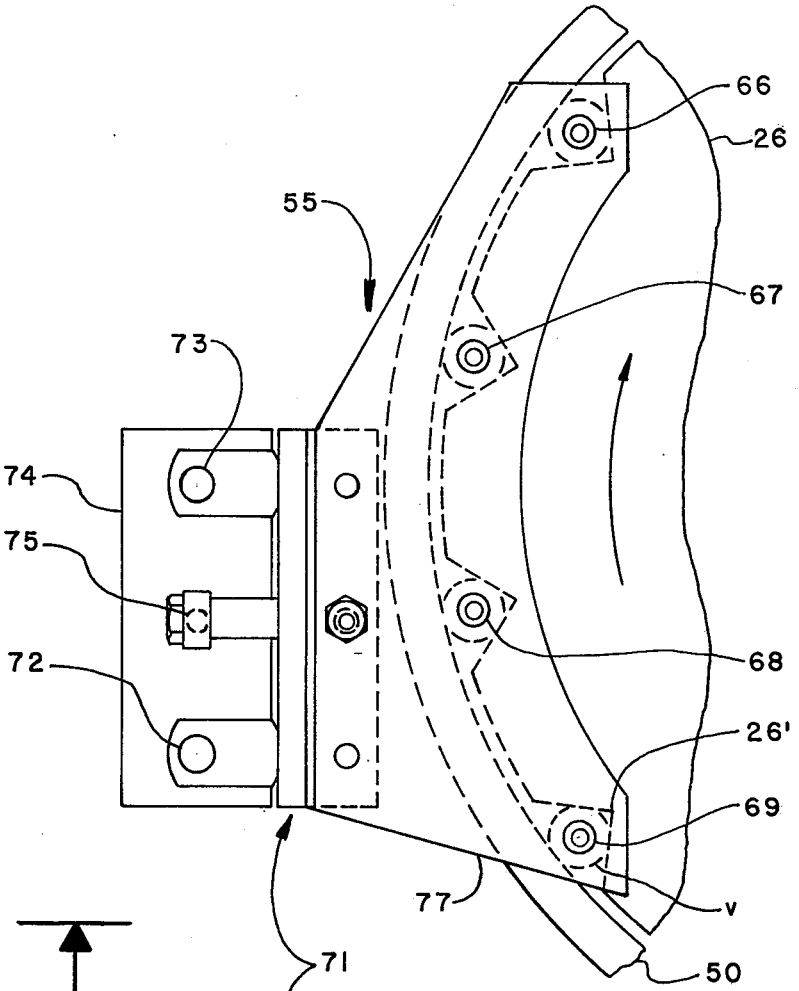
FIG. 4 is a plan view of the filling station of the machine.
Figure 5:
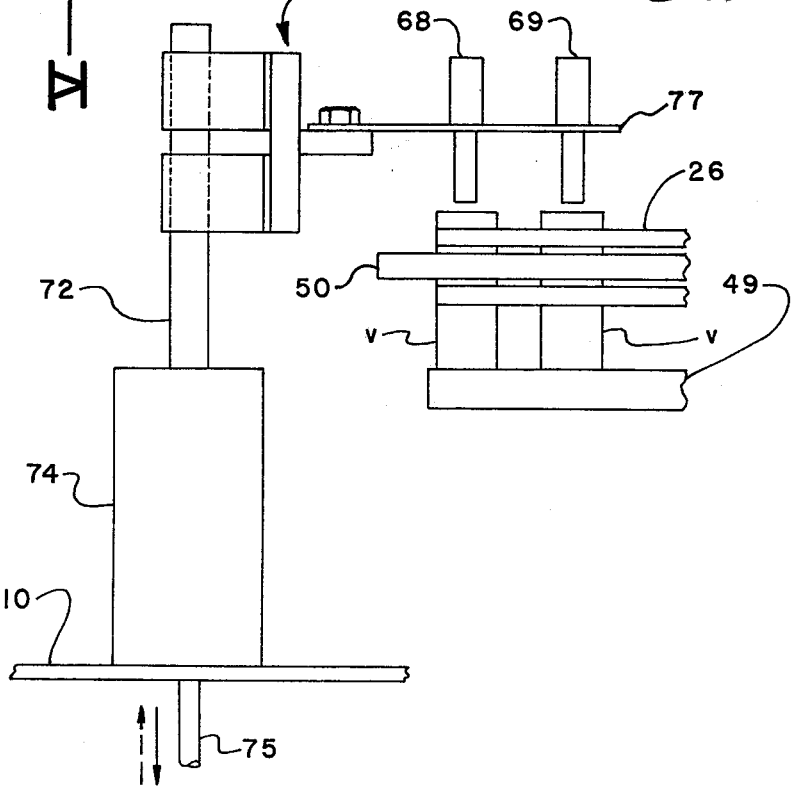
FIG. 5 is an elevation of the filling station as viewed from plane V—V of FIG. 4.
Figure 6:
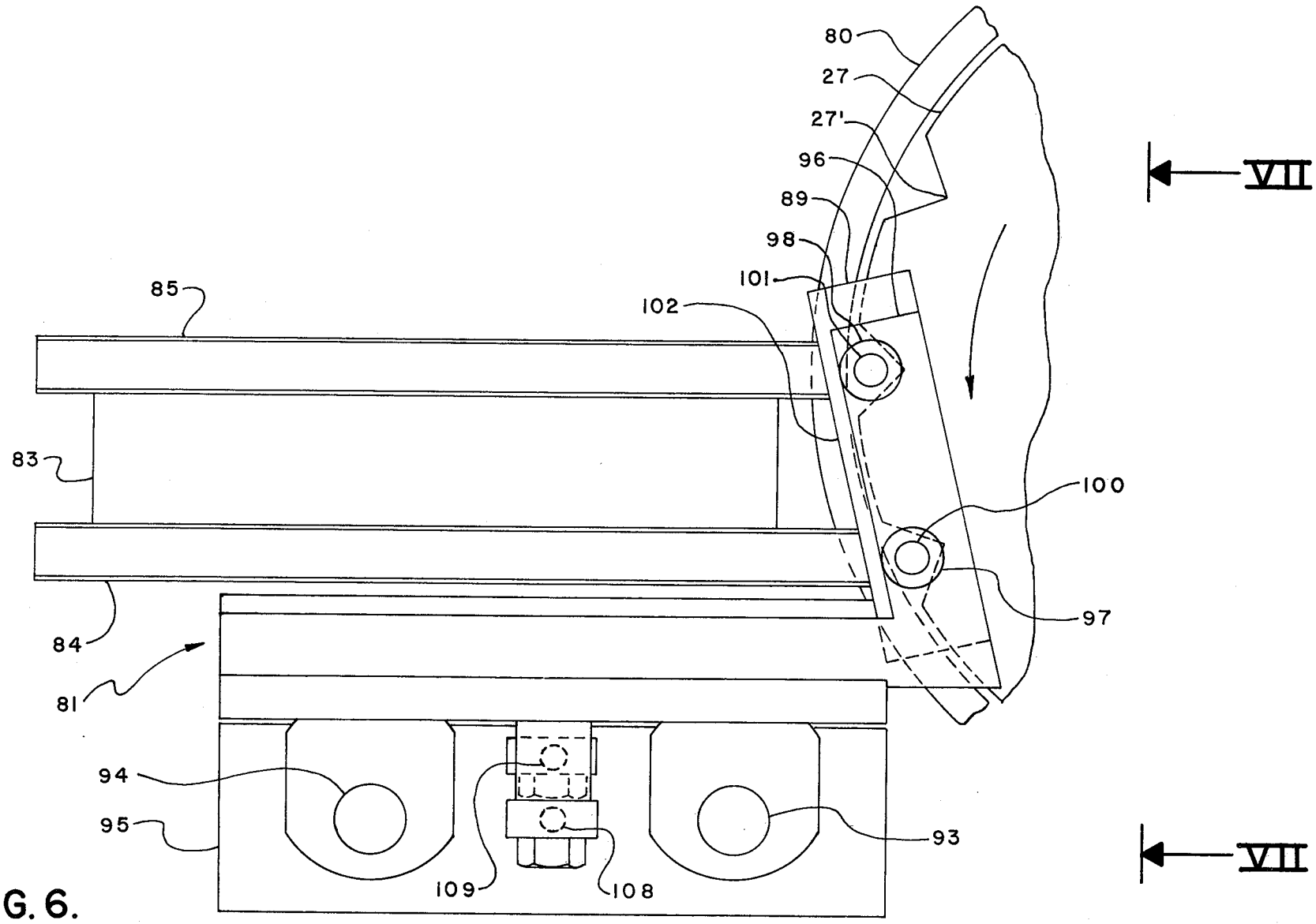
FIG. 6 is a plan view of the plugging station of the machine.

A pair of the vials *v* are received in respective tracks 23 and 24 provided in a chute 25 for conveying the vials from the ramp 15 to the first turret 26 of a pair of turrets 26 and 27. A kicker bar 28 propels the pair of vials *v* along the chute 25 (FIGS. 2 and 3).

The kicker bar 28 is actuated by a slide assembly 31 supported by an arm 32 mounted on the pedestal 22. The slide assembly 31 comprises a frame 33 supporting a pair of horizontal slide rods 34 and 35, one vertically arranged above the other. The kicker bar 28 is mounted on a carriage 36 which is slidably reciprocably mounted on the slide rods 34 and 35. Reciprocation of the carriage 36 is effected by means of a cable 37 which passes through the top plate 10 and a housing 38 mounted on the top plate 10. A pair of pulleys 40 and 41 is mounted on an arm 42 on the carriage 33. Three additional pulleys, two of which 43 and 44 are shown, are mounted on another arm 45 on the carriage 33. The cable 37 passes over a pulley 40, over then under and over the three respective pulleys on the arm 45 and then over the pulley 41. Therefc e, by pulling of the respective portions **37*a* and 37*b* of the cable 37, by means which will hereinafter be described, the carriage 36** is reciprocated to and fro.

Each of the turrets 26 and 27 is provided with respective notches 26' and 27' for receiving the vials. The turrets 26 and 27 are rotationally indexed by a distance corresponding to two notches at a time, by means hereinafter to be described. A pair of vials *v*, first propelled horizontally along the chute 25 by the kicker bar 28 and then falling vertically through the downward portion of the chute 25 are received in a respective pair of notches 26' in the turret 26. The turret assembly 26, like which the turret assembly 27 is also constructed, includes a housing 46 which supports the assembly on the top plate 10 and through which the shaft for driving the turret passes, a hub 47 and the turret proper 48, including a ride rail 49 for supporting the bottoms of the vials *v*, a guide rail 50 in contact with the outer surface of the vials *v* and respective upper and lower members 51 and 52 containing the notches 26'.

The indexing of the turret 26 then brings the vials *v* to a filling station 55. The filling station 55 includes a set of four metering pumps 56 – 59. The metering pumps 56 – 59 are driven by a shaft 62 on one end of which is mounted a sprocket 63. The sprocket 63 is driven by means which will be described hereinbelow. With each of the pumps 56 – 59 is associated a respective outlet conduit 56', 57', 58' and 59'. A reservoir (not illustrated) for the liquid with which the vials *v* are to be filled is also provided. Respective inlet conduits (not illustrated) communicate between the reservoir and the pumps 56 – 59. The filling station 55 also includes a carriage 71 mounted for vertical reciprocation on a pair of vertical slide rods 72 and 73 supported on the top plate 10 by means of a housing 74. Reciprocation of the carriage 71 is effected through the tie rod 75 which is fastened to the carriage 71 and reciprocated up and down by means which will hereinafter be described.

To the carriage 71 is fastened a horizontal plate 77 through which pass the four respective nozzles 66, 67, 68 and 69, these nozzles communicating through tubing (not illustrated) with the respective outlet conduits 56', 57', 58' and 59' of the respective pumps 56, 57, 58 and 59. In order to minimize bubbling and foaming, the nozzles 66 – 69 are lowered by means of the carriage 71 into the vials *v* and then withdrawn as the vials *v* are filled through the nozzles so that the liquid falls only a small distance. For filling large vials, all four pumps are operated. A pair of vials is partially filled by the first two nozzles 69 and 68 and then indexed to the next two nozzles 67 and 66 where the filling is completed. The reason is simply that two stages of filling for a larger vial are necessary in order that the turrets need not be operated at a slower speed than the other operations permit them to be operated at. For smaller vials, one might operate only the first two of the pumps, a second stage of filling not being necessary. A drain 78 is mounted on the top plate 10 for the purpose of collecting any accidental spillage of the liquid.

After the filling operation, the vials must be provided with the aforementioned plugs and caps. For this purpose, the vials are transferred from the turret 26 to the turret 27. This is accomplished automatically. While the turret 26 rotates clockwise as viewed in FIG. 1, the turret 27 rotates counterclockwise as viewed in FIG. 1. As mentioned hereinabove, a stationary guide rail 50 is associated with the turret 26. Similarly, a stationary guide rail 80 is associated with turret 27. Through the space defined between the leading end 50*a* of the guide rail 50 and the trailing end 80*a* of the guide rail 80, each vial *v* is automatically transferred from the turret 26 to the turret 27. The trailing end of the guide rail 80*a* simply prevents a vial *v* from being carried any further around the turret 26 and guides the vial *v* into a vacant notch of the turret 27. The turret 27 transports the vials *v* first to a plugging station 81 and then to a capping station 82.

As in the entire operation of the machine, indexing continues to be two vials at a time, so that the vials *v* are plugged and capped two at a time. The plugging station 81 is provided with plugs from a vibratory circular feed bowl 12. The plugs are fed from the vibratory circular feed bowl 12 to a linear vibratory feeder 83 provided with a pair of tracks 84 and 85. The tracks 84 and 85 guide plugs to two adjacent die openings 87 and 88 provided in a die 89 constituting part of the plugging station 81. The openings 87 and 88 are in axial alignment with the vials *v* held by two respective notches in the turret 27 directly below the openings 87 and 88. The top mouth of each of the openings 87 and 88 is of slightly larger diameter than the maximum diameter portion of the plugs *p*. However, the openings 87 and 88 are very slightly tapered (too slightly to be illustrated in the present drawings) so that the bottom mouth of the openings 87 and 88 is very slightly smaller than the maximum diameter portion. Therefore, the plugs *p* are retained in the openings 87 and 88 but can readily be pushed out therefrom, due to the resilient deformability of the plugs *p*.

Figure 7:
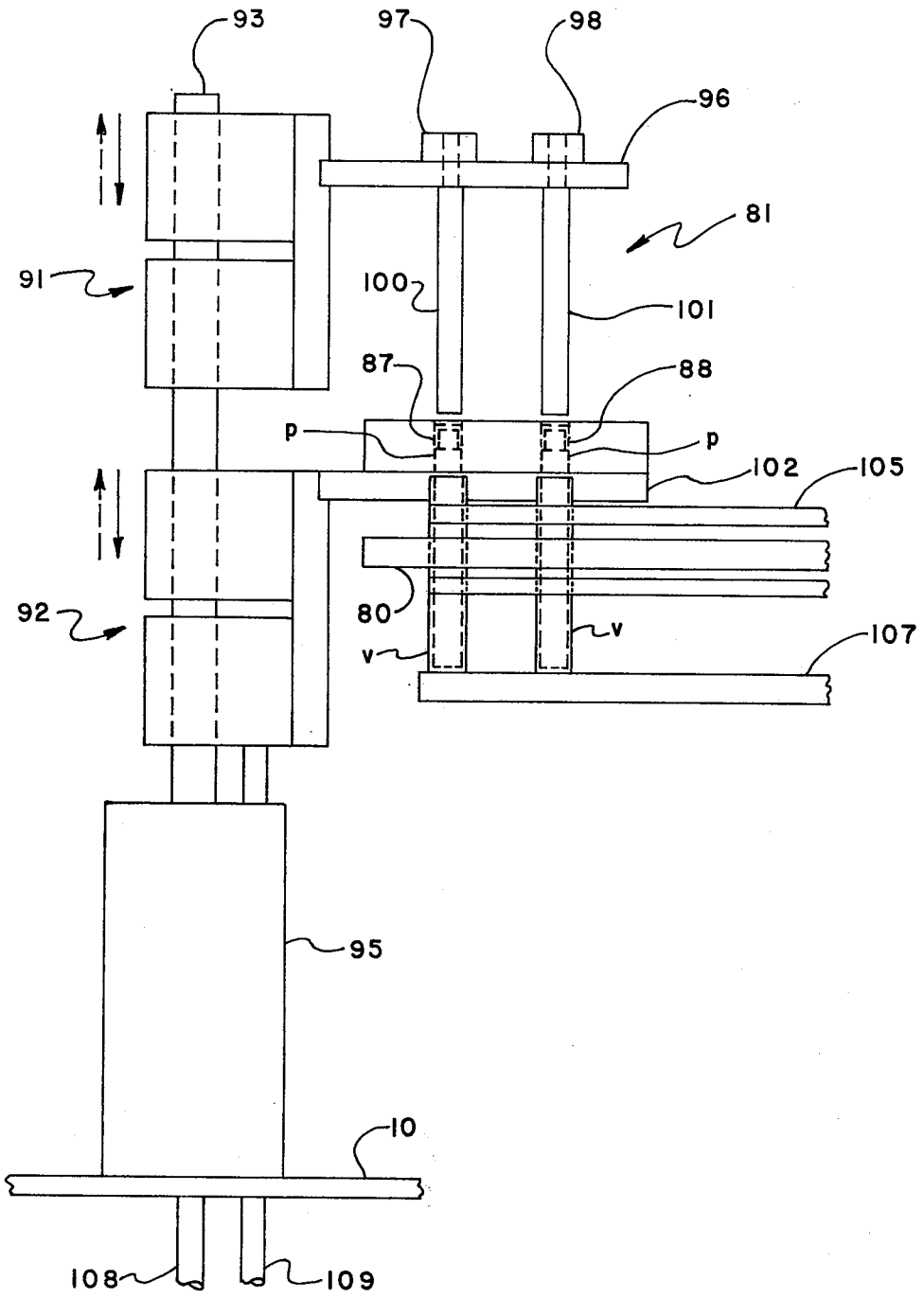
FIG. 7 is an elevation of the plugging station as viewed from plane VII—VII of FIG. 6.
Figure 8:
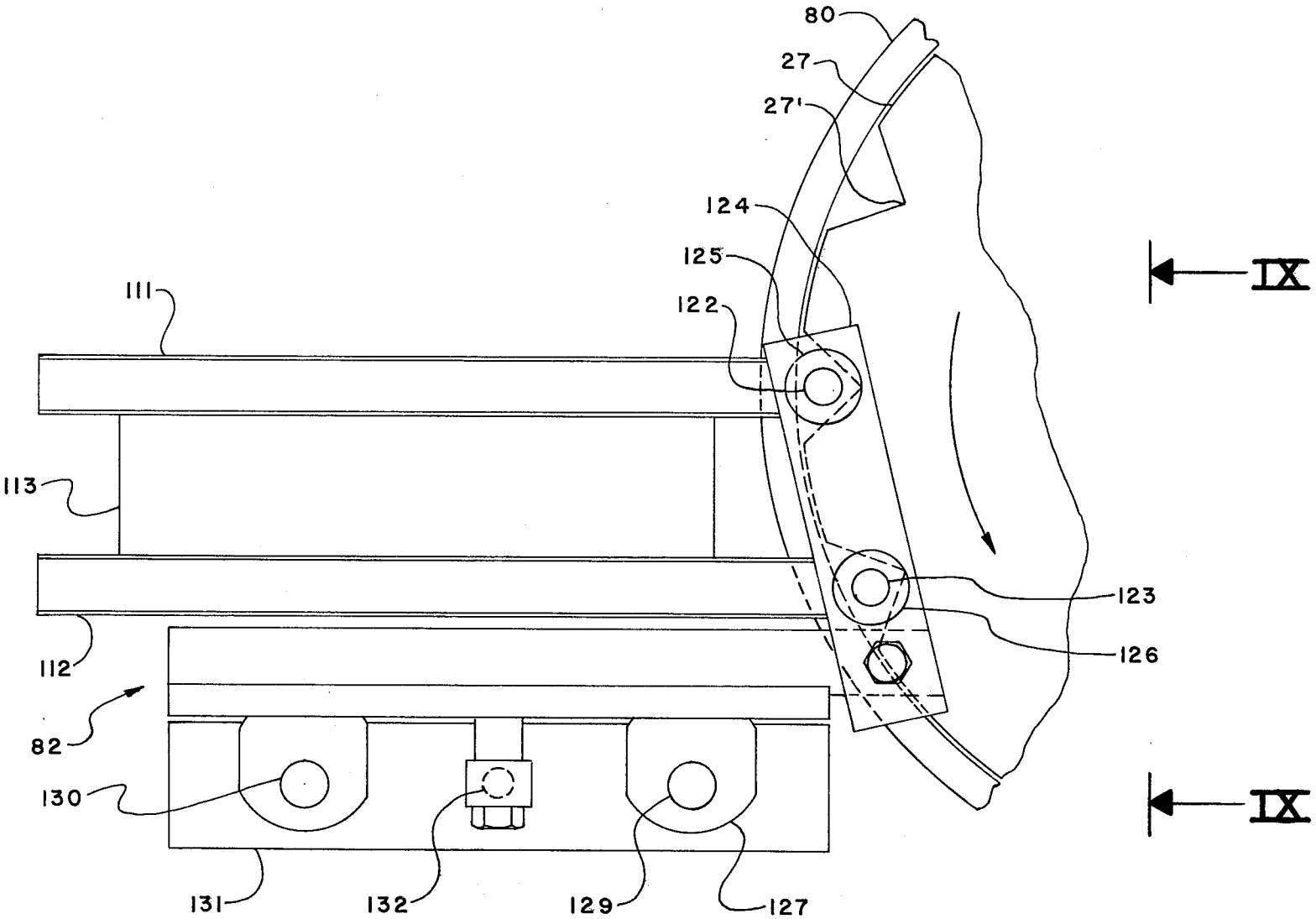
FIG. 8 is a plan view of the capping station of the machine.

The plugging station 81 also includes an upper carriage 91 and a lower carriage 92, both carriages being vertically reciprocably mounted on a pair of vertical slide rods 93 and 94, the slide rods 93 and 94 being mounted on the top plate 10 by means a housing 95. Fastened to the carriage 91 is a horizontal arm 96 on which is mounted by means of collars 97 and 98 provided with set screws, a pair of punches 100 and 101 of diameter smaller than the minimum diameter of the openings 87 and 88 and smaller than the internal diameter of the vials *v*. The die 89 is mounted on a horizontal arm 102 fastened to the carriage 92. In FIG. 7 can also be seen the upper notch member 105, lower notch member 106, ride rail 107 and guide rail 80 of turret 27.

The carriage 91 is reciprocated up and down by means of a tie rod 108 fastened to the carriage 91, and the carriage 92 is reciprocated up and down by means of a tie rod 109 fastened to the carriage 92. The means for actuating the tie rods 108 and 109 will be described hereinbelow. The die 89 containing a respective plug *p* in each of the openings 87 and 88 is lowered onto the pair of vials *v* directly therebelow by means of lowering the carriage 92. Then, the carriage 91 is lowered sufficiently to cause the punches 100 and 101 to drive the plugs *p* into the vials *v* to the desired level, the plugs *p* thereby being inserted into the vials *v* so that the lower extremities of the plugs *p* are just above the liquid level in the vials *v* and sufficient space in the vials *v* is provided by the plugs *p* to permit insertion of the caps *c* at the capping station 82. The carriages 91 and 92 are then returned upwardly to their rest positions, which are illustrated in FIG. 7.

The pair of vials *v* are then indexed two at a time to the capping station 82.

Figure 9:
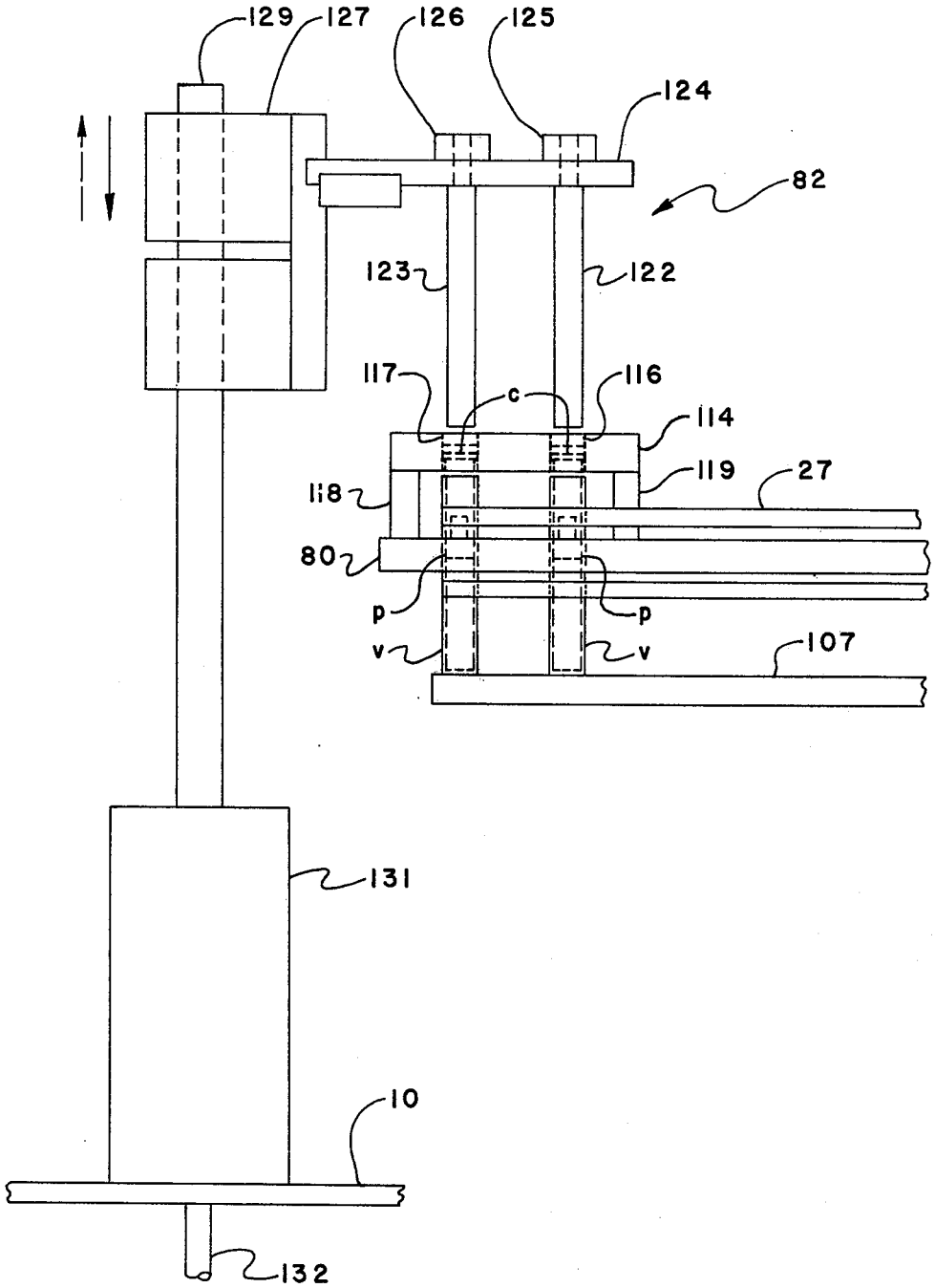
FIG. 9 is an elevation of the capping station as viewed from plane IX—IX of FIG. 8.

Caps *c* are provided to the capping station 82 by means of a vibratory circular feed bowl 13 which communicates with the pair of tracks 111 and 112 of a linear vibratory feeder 113. The other ends of the tracks 111 and 112 communicates with a stationary die 114 at the capping station 82. The die 114 is provided with a pair of openings 116 and 117 which communicate with the respective tracks 111 and 112. The openings 116 and 117 are in axial alignment with a pair of vials *v* held in adjacent notches in the turret 27 directly below the die 114. The die 114 is supported by means of spacers 118 and 119 extending between the die 114 and the guide rail 80. The over-all diameter of each of the openings 116 and 117 is slightly greater than the largest diameter of the cap *c*. However, formed in each of the openings 116 and 117 on a scale too small to be illustrated in FIG. 9 is an annular lip for retaining a cap *c* in the respective opening 116 or 117. The resiliency of the cap *c* permits the cap *c* to be pushed past the annular lip. Mounted directly above and in axial alignment with the respective openings 116 and 117 is a pair of punches 122 and 123 which are of smaller diameter than the smallest diameter of the openings 116 and 117. The punches 122 and 123 are supported on a horizontal arm 124 by means of respective collars 125 and 126, each of which is provided with a set screw (not illustrated). The arm 124 is fastened to a carriage 127 which is reciprocably slidably mounted on a pair of slide rods 129 and 130. The slide rods 129 and 130 are supported on the top plate 10 by means of a housing 131. The carriage 127 is reciprocated by means of a tie rod 132 which is fastened to the carriage 127. The tie rod 132 is actuated by means which will be described hereinbelow. Lowering of the carriage 127 from the rest position illustrated in FIG. 9 causes the punches 122 and 123 to push the caps *c* into the vials *v* above the plugs *p*.

Figure 11:
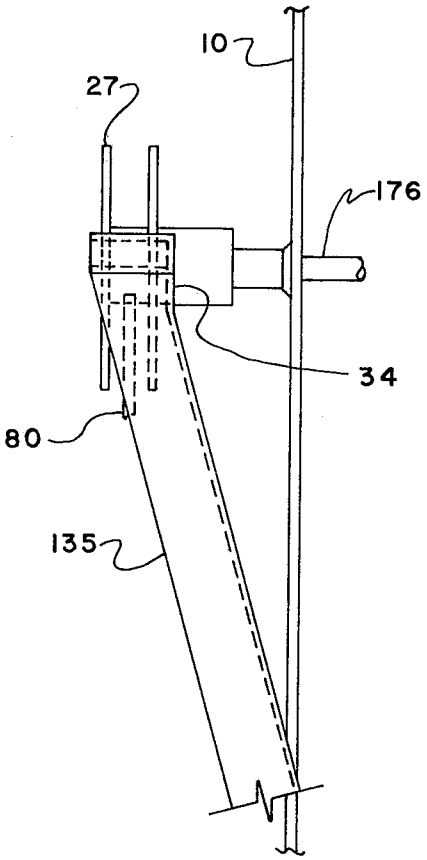
FIG. 11 is an elevation of the discharge section as viewed from plane XI—XI of FIG. 10.
Figure 10:
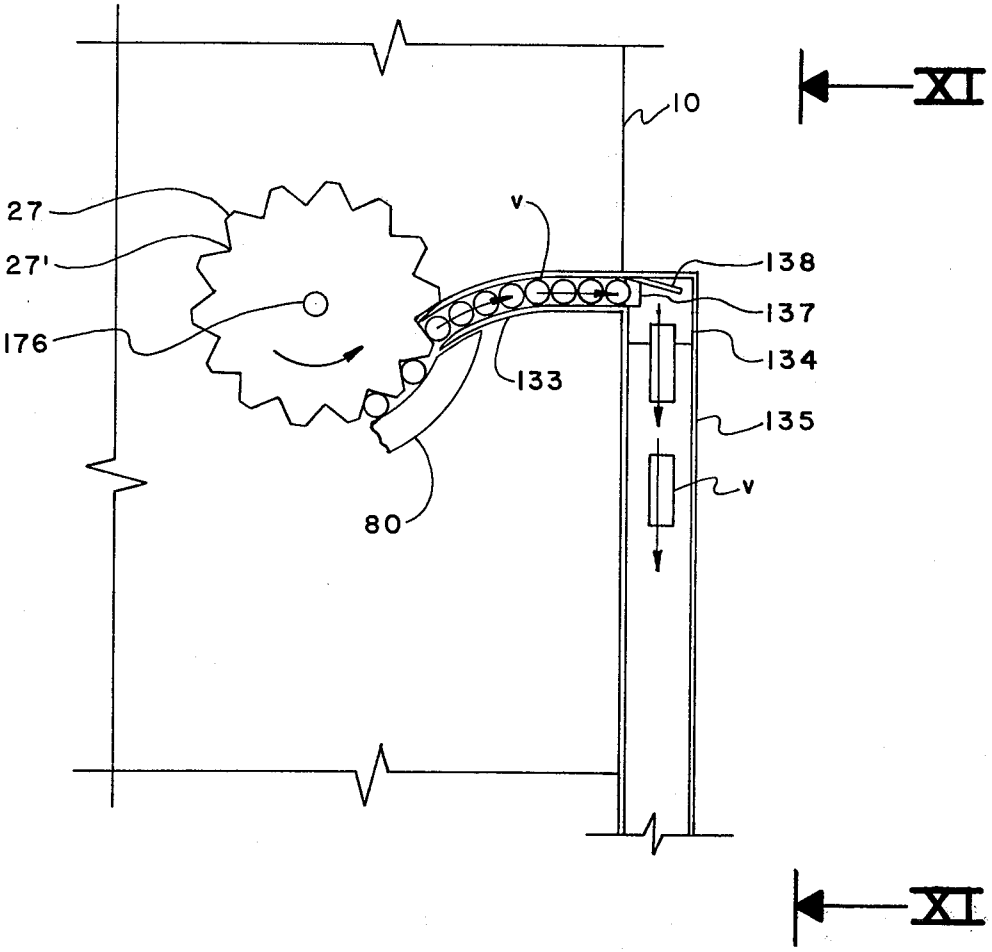
FIG. 10 is a plan view of the discharge section of the machine.

The filled, plugged and capped vials *v* are now to be discharged from the machine. This is accomplished by the turret 27 pushing the filled, plugged and capped vials onto a horizontal track 133 (FIGS. 1 and 10). The horizontal track 133 communicates with a horizontal plate 134 which, in turn, communicates with a downwardly sloped chute 135 (FIGS. 10 and 11). At the juncture of the track 133 and the plates 134 is provided an opening 137. Adjacent the opening 137 and extending obliquely over the plate 135 is a vertical guide plate 138. The dimension of the opening 137 in the direction normal to the direction of travel of the vials is greater than the diameter of the vials whereas the dimension of the opening 137 normal thereto is less than the diameter of the vials so that the vials do not fall through the opening 137. When a vial is pushed over the opening 137, the partial absence of support due to the presence of the opening 137 causes the vial to fall forward, whereupon it is deflected by the guide plate 138. This combination of tilting over and deflecting causes the vial *v* to move from its vertical orientation on the track 133 to its inclined orientation on the chute 135. Whatever manual or machine handling the filled and assembled vial *v* is subjected to after it leaves the chute 135 forms no part of the present invention.

The means for driving the various hereinabove described parts of the machine of the invention are housed between the top plate 10 and the bottom plate 140 of the machine. All the mechanisms are driven by a motor 141 which drives a drive shaft 142 through a gear box 143. A sprocket 144 is mounted on the shaft 142. A shaft extends above the motor 141 horizontally across the width of the frame of the machine, being supported near one end by a bearing 146 in frame member 147 of the machine and being supported at the other end by a bearing 148 in frame member 149 of the machine. Mounted on the shaft 145 is a sprocket 152. The shaft 145 is driven by a chain 153 which is trained over the sprockets 144 and 152.

The tie rod 132 is connected to the carriage 127 of the capping station 82 and actuated by a cam 154 mounted on the shaft 145. Pivotally connected to the lower end 132*a* of the tie rod 132 is a lever 155 on which is mounted a cam follower 156. The engagement of the cam follower 156 with the cam 154 causes the tie rod 132 to be reciprocated by the lever 155 as the shaft 145 rotates.

A cam 158 is mounted on the shaft 145 for actuating the tie rod 108 which is connected to the carriage 91 of the plugging station 81. Pivotally connected to the lower end 108*a* of the tie rod 108 is a lever 159 mounted on which is a cam follower 160 which engages the cam 158. Hence, the cam 158 actuates the tie rod 108 in the same manner that the cam 154 actuates the tie rod 132.

A cam 161 is mounted on the shaft 145 for actuating the tie rod 109. To the lower end 109*a* of the tie rod 109 is pivotally connected a lever 162 on which is mounted a cam follower 163 which engages the cam 161. Hence, the cam 161 actuates the tie rod 109, which is connected to the carriage 92 of the plugging station 81 in the same manner as hereinabove described with reference to the tie rods 132 and 108.

For driving the pumps 56 – 59, there is mounted on the shaft 145 a sprocket 165. The chain (not illustrated) is trained over the sprockets 165 and 63, whereby the pumps are driven.

For actuating the tie rod 75 which is connected to the carriage 71, a cam 165 is provided on the shaft 145. To the lower end 75*a* of the tie rod 75 pivotally connected to a lever 166 on which is mounted a cam follower 167 which engages the cam 165. Thus, tie rod 75 is actuated in the same manner as tie rods 132, 108 and 109.

The cable 37 which moves the carriage 36 is actuated by a cam 168 mounted on the shaft 145. Both ends 37*a* and 37*b* of the cable 37 are pivotally connected to a lever 169 on which is mounted a cam follower 170 which engages the cam 168. In order to prevent confusion caused by intersecting and overlapping lines in FIG. 12, there is illustrated only the connection of the end 37*a* of the cable 37 to the lever 169 and only a portion of the other end 37*b* of the cable 37 is illustrated. However, it can readily be understood that the cable end 37*b* is trained under a pulley (not illustrated) fastened to the bottom plate 140 of the machine and thereafter is pivotally connected to the lever 169.

A cam 173 is mounted on the shaft 145 for actuating the tie rod 18 for the hopper wheel 14. To the lower end 18*a* of the tie rod 18 is pivotally connected a lever 174 on which is mounted a cam follower 175 which engages the cam 173, whereby the tie rod 18 is actuated in the same manner as the tie rods 132, 108, 109 and 75.

Figure 12:
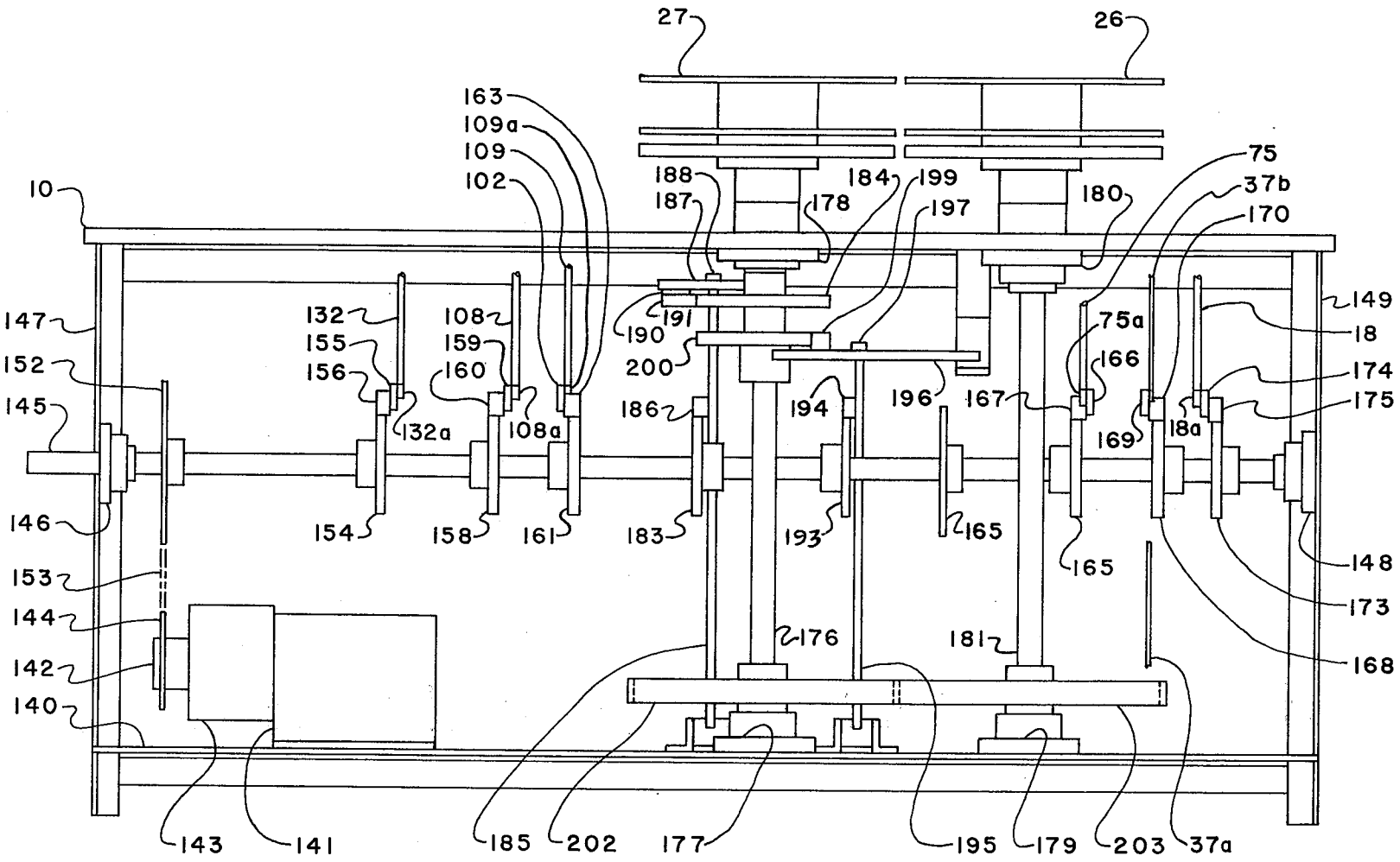
FIG. 12 is an elevation of the drive mechanisms of the machine.

The turret 27 is directly indexed and the indexing thereof is transmitted to the turret 26, all of which will now be described. The turret 27 is mounted on a shaft 176 which is rotatably supported by a bearing 177 mounted on the bottom plate 140 of the machine and a bearing 178 suspended from the top plate of the machine. Similarly, the turret 26 is mounted in a shaft 181 supported by bearings 179 and 180 at the bottom and top plates, respectively, of the machine. A cam 183 mounted on the shaft 145 actuates the primary indexing. An index wheel 184, in the form of a ratchet wheel, is mounted on the shaft 176. A vertical lever 185 is provided with a cam follower 186 which engages the cam 183. The lever 185 is connected to a horizontal lever 187 by means of a tie rod, an end 188 of which is seen in FIG. 12. A spacer 190 is connected to the lever 187 and to the spacer 190 is connected a pawl 191. The engagement of the cam follower 186 with the cam 183 rocks the lever 185 whereby horizontal motion is imparted to the lever 187 which causes engagement of the pawl 191 with the ratchet wheel 184 to rotationally index the turret 27.

To assure that in each indexing step momentum does not carry the turret 27 beyond the desired end of the indexing step, a locking mechanism is provided, which will now be described in detail. For the purpose of actuating the locking mechanism, a cam 193 is provided on the shaft 145. The cam 193 engages a cam follower 194 mounted on a vertical lever 195. The vertical lever 195 is connected to a horizontal lever or locking bar 196 by means of a tie rod, an end 197 of which appears in FIG. 12. Mounted on the locking bar 196 is a cam follower 199. The cam follower 199 cooperates with a lock wheel 200 mounted on the shaft 176. The lock wheel 200 is provided with a V-shaped cut-out. As the indexing of the turret 27 is being completed, horizontal actuation of the locking bar 196 effected by vertical actuation of the lever 195 by the cam 193 urges the cam follower 199 into the V-shaped cut-out in the lock wheel 200, which prevents the turret 27 from moving past the position to which it has been indexed. Conversely, as indexing of the turret 27 is to begin again, the cam 193 causes vertical motion of the lever 195 which results in horizontal motion of the locking bar 196 to withdraw the cam follower 199 from the V-shaped cut-out, thereby to permit the indexing. On the shaft 176 near the bottom thereof, there is mounted a gear 202, and, similarly, on shaft 181 near the bottom thereof is mounted a gear 203. The gears 202 and 203 mesh so that whatever amount of rotation is imparted to the turret 27 is transmitted through the gears 202 and 203 to the turret 26, which, of course, is caused to rotate in the opposite direction.

The machine of the invention is readily adaptable to the handling of vials and corresponding plugs and caps of different sizes. As pointed out hereinabove, when smaller vials are to be filled, two of the four pumps may be disconnected. Moreover, the capacity of conventional metering pumps is adjustable. Apart from such pump adjustments, when switching from one vial size to another, different sized turrets, hopper wheels, dies and chutes are substituted.

While the invention has been particularly described by reference to a specific embodiment thereof, it is to be understood that such description is intended to illustrate rather than limit the invention as defined by the hereto appended claims.

What I claim is:

1. Apparatus for partially filling with a liquid a cylindrical vial having one open end, inserting a plug into the open end and fitting a cap onto the open end, comprising first and second turrets, a plurality of notches provided in the periphery of each of the turrets, the notches each being sized and shaped for receiving a respective one of the vials in an upright orientation with the open end thereof directed upwardly, means for feeding respective vials into respective notches of the first turret so that each vial is received in a respective notch in an upright orientation with the open end thereof directed upwardly, located adjacent said first turret a filling station for partially filling vials in notches of the first turret with a liquid, means for rotationally indexing the turrets in opposite directions, the turrets abutting each other thereby defining a zone of closest mutual proximity of the turrets to facilitate transfer of vials from the first turret to the second turret, means for guiding transfer of the vials in said zone from the first turret to the second turret, said zone being rotationally spaced from the filling station in the direction of rotation of the first turret so that the partial filling of the vials is effected before they are transferred to the second turret, adjacent said second turret a plugging station for inserting plugs into the vials in notches of the second turret at a location rotationally spaced from said zone in the direction of rotation of the second turret, a capping station for fitting caps onto the vials in notches of the second turret at a location rotationally spaced from said plugging station in the direction of rotation of the second turret and means for discharging the partially filled, plugged and capped vials from the second turret at a location rotationally spaced from the capping station in the direction of rotation of the second turret.

2. Apparatus according to claim 1, in which the means for feeding vials to the first turret comprises a hopper, a ramp upwardly inclined toward the first turret from a lower portion of the hopper and a wheel for discharging vials from the lower portion of the hopper onto the ramp.

3. Apparatus according to claim 2, in which the wheel is arranged to discharge the vials onto the ramp so the vials lie across the ramp and the means for feeding vials to the first turret further comprises means for receiving the vials from the ramp and guiding the vials from the ramp to notches in the first turret and means for striking the vials thereby to propel the vials along said receiving and guiding means into said notches in the first turret.

4. Apparatus according to claim 3, in which the ramp extends to an elevation above the elevation of the top of the first turret and the receiving and guiding means comprises a chute extending substantially horizontally away from the ramp and substantially vertically downwardly to a position immediately above the first turret so that the vials drop into noteches of the first turret in a vertical orientation.

5. Apparatus according to claim 4, in which said filling station comprises a plurality of pumps, a respective nozzle communicating with each of said pumps, a carriage supporting said nozzles above notches of said first turret and means for reciprocating said carriage substantially vertically so that cyclically said nozzles lower into and then raise out of vials in respective notches of said first turret as the pumps pump liquid through said nozzles into said vials.

6. Apparatus according to claim 5, further comprising a vibratory circular feed bowl for containing a suppy of and feeding the plugs and a linear vibratory feeder communicating between the feed bowl and the plugging station, the plugging station further comprising a die having openings for receiving plugs from the linear feeder, the openings in said die being aligned with vials received in notches of the second turret, a respective punch for each of the openings in the die, each said punch being in alignment with a respective die opening, a first carriage supporting said die above notches of said second turret and a second carriage supporting said punches above said die, respective means for reciprocating said first and second carriages substantially vertically so that cyclically said die lowers plugs to a position just above the mouths of respective vials in respective notches of said second turret whereupon said punches drive plugs into said vials.

7. Apparatus according to claim 6, further comprising a vibratory circular feed bowl for containing a supply of and feeding the caps and a linear vibratory feeder communicating between the feed bowl and the capping station, the capping station further comprising a die having openings for receiving caps from the linear feeder, the openings in said die being aligned with vials received in notches of the second turret, a respective punch for each of the openings in the die, each said punch being in alignment with a respective die opening, means supporting said die above notches of said second turret, a carriage supporting said punches above said die, and means for reciprocating said carriage substantially vertically so that cyclically said punches push caps onto vials in respective notches of said second turret.

* * * * *